US007126454B2

(12) United States Patent
Bulmer

(10) Patent No.: US 7,126,454 B2
(45) Date of Patent: Oct. 24, 2006

(54) ALERT SYSTEM

(76) Inventor: Michael W. Bulmer, 21320 W. 98th St., Lenexa, KS (US) 66220

( * ) Notice: Subject to any disclaimer, the term of this patent is extended or adjusted under 35 U.S.C. 154(b) by 0 days.

(21) Appl. No.: 10/995,026

(22) Filed: Nov. 22, 2004

(65) Prior Publication Data

US 2005/0151639 A1 Jul. 14, 2005

Related U.S. Application Data

(60) Provisional application No. 60/524,000, filed on Nov. 21, 2003.

(51) Int. Cl.
*G09F 25/00* (2006.01)
*G08B 1/08* (2006.01)
*G08G 1/09* (2006.01)

(52) U.S. Cl. ..... 340/286.01; 340/539.1

(58) Field of Classification Search ..... 340/539.1, 340/286.1, 905, 539.16
See application file for complete search history.

(56) References Cited

U.S. PATENT DOCUMENTS

| | | | | |
|---|---|---|---|---|
| 5,701,580 | A * | 12/1997 | Yamane et al. | 455/3.01 |
| 6,462,665 | B1 * | 10/2002 | Tarlton et al. | 340/601 |
| 6,608,559 | B1 * | 8/2003 | Lemelson et al. | 340/539.13 |
| 6,741,165 | B1 * | 5/2004 | Langfahl et al. | 340/426.1 |
| 6,747,557 | B1 * | 6/2004 | Petite et al. | 340/540 |
| 2004/0193617 | A1 * | 9/2004 | Adler | 707/100 |

* cited by examiner

*Primary Examiner*—Daryl C Pope
(74) *Attorney, Agent, or Firm*—National IP Rights Center

(57) ABSTRACT

A system for alerting the public regarding a criminal act; a plurality of law enforcements modes which generate alerts related to a criminal or emergency issue and transmit the same to a central server; a central server system including an administration workstation and database for receiving the alerts and creating broadcast messages; a broadcast system associated with the central server for broadcasting an alert via a televised broadcast, internet transmission or satellite transmission.

3 Claims, 6 Drawing Sheets

FIG. 4a

Screen 1

Alert

Bank Robbery In Progress
At Wachovia Bank 4th and Main

FIG. 4b

Screen 2

Photo Suspects

FIG. 4c

Screen 3

Identification
Of Vehicle
2002 Ford Taurus

ALERT SYSTEM

CLAIM OF PRIORITY

This application claims priority of Provisional Patent Application No. 60/524,000 filed Nov. 21, 2003.

FIELD OF THE INVENTION

The present invention is directed to the area of alert systems. In particular, the present invention is an alert system which is directly connected to police, fire, and other disaster management agencies where messages can be conveyed to the public via television, radio, satellite, internet or other transmission means.

BACKGROUND OF THE INVENTION

With the advent of television programs such as America's Most Wanted and the proliferation of the Internet, it has become easier for members of the public to assist law enforcement in apprehending potential lawbreakers. It has been well-established that the prospects for apprehending a criminal is the greatest during the earliest time period following a crime. It is during this time when the criminal is in flight. The need for improved criminal detection systems is particularly urgent in view of the events of Sep. 11, 2001 and the prospect for future acts of terrorism. It has been repeatedly shown that citizen participation is of great assistance in law enforcement. The critical shortcoming has been to provide a system which can be quickly provided to the public to materially assist law enforcement.

There have been a number of patents directed to the area of alert systems. U.S. Pat. No. 6,543,051 discloses a system for inputting conventional emergency alert messages, such as tornado or flash flood warnings, into a digital subscriber television system. The method allows existing emergency alert equipment to interface with the digital system equipment in the headend of a digital subscriber television system. A unique identifier and the format of the digital emergency alert message allow the input of an emergency alert message and allow for a wide variety of optional data formats, system control options, and data storage options.

U.S. Pat. No. 6,498,627 discloses a brevity signaling module for a digital television (DTV) receiver enables the reception of emergency broadcast messages. The overlay signal received at the receiver front end is squared in a squaring loop, producing spectral lines at DC and twice the overlay signal frequency, or 2.omega., where .omega.=2.pi.f and f is the center frequency of the overlay signal. The squared signal is passed through a narrow band filter having a bandwidth sufficient to pass a spectrum containing a plurality of tones 2.omega., 2.omega..sub.1, 2.omega..sub.2, . . . , 2.omega..sub.n, where 2.omega..sub.1, 2.sub.2 . . . , 2.omega..sub.n are different frequency tones assigned to different auxiliary functions. The detected tone is used by a control module to determine whether normal multi-path processing should be performed or whether this processing should be suppressed and auxiliary functions performed, including turning on the DTV receiver power in order that an emergency broadcast message might be conveyed to persons in the vicinity of the DTV receiver.

U.S. Pat. No. 6,204,761 discloses a weather alert system to warn a user when an emergency signal has been broadcast and to simultaneously activate a television or other visual information source and to select a predetermined informational channel. The weather alert system includes a signal detector for detecting a broadcast alarm signal and for generating an activation signal upon detection of the alarm signal. A remote controller is operatively connected to the signal detector for producing a remote control signal in response to said activation signal. The remote control signal is utilized to trigger the activation of a visual information source such as a television or a computer to provide visual information relating to the hazardous condition.

U.S. Pat. No. 6,543,051 discloses a geographically specific emergency alert system, principally directed to weather alerts, including a code generator unit in which geographic areas to be alerted and types of severity of alerts are selected and code strings generated to represent the affected areas and alert types selected. The code strings are broadcast by modulating the audio carrier of a television signal and received on receiver units positioned in areas within the broadcast market of a television station providing the alerting service. Location codes or entered into the receiver units by the users according to the areas in which the receiver units are used. When an alert is broadcast, each receiver unit decodes a location code string in the signal. If it matches that set on the receiver, an alert code string is decoded to activate an alarm devices connected to the receiver, such as an audible alarm generator, LED, etc., in accordance with the type or severity of alert that was broadcast.

U.S. Pat. No. 4,155,042 discloses a disaster alert system which consists of two major sub-systems. The first subsystem is a central disaster alert station which transmits coded R.F. activation signals specifying the geographic area and/or the official personnel to be alerted. Said central disaster alert station also transmits audio signals containing the disaster warning message to be disseminated to potential disaster victims and/or pre-selected official personnel. The second and companion sub-system consists of a plurality of independent and remotely located disaster alert modules which can be placed in any location to which disaster alert information is to be disseminated. Said disaster alert modules operate on continuous low-power standby, receiving and analyzing R.F. signals of a pre-determined carrier frequency and bandwidth. In the absence of said coded activation signal, said disaster alert modules remain in low-power standby. Detection and decoding of said coded activation signals results in activation of the module main power circuits. Activation of main power circuits results in a plurality of module outputs, including but not limited to, production of a clearly audible alarm signal, display of a clearly visible alarm signal, reproduction of the audio message, and activation of desirable auxiliary units equipped with said modules, such as, but not limited to, television receivers, public address systems, and civil defense sirens. Specially designated disaster alert modules located on or near roadways produce, upon similar activation, conspicuous alarm signals, and display disaster alert information on road signs. Said disaster alert modules operate on self contained battery power with means provided for continuous or occasional re-charging from A.C. lines. Said disaster alert modules remain operative in the event of A.C. power failure. The low-power standby mode is intended to conserve energy and maintain extended battery life, and to preclude discernible outputs when no disaster conditions exist.

While there have been a number of systems for alerting or warning the public of criminal matters and the like, there have been no effective systems for permitting criminal warnings to be widely broadcast at a point in time where the information can be widely and immediately disseminated to the public to maximize assistance to law enforcement.

OBJECTS AND SUMMARY OF THE PRESENT INVENTION

It is an object of the present invention to provide a global notification system whereby the public can be notified of a criminal activity.

It is a further object of the present invention to provide a television or internet channel which can alert the public of an ongoing crime and seek assistance;

It is a further object of the present invention to provide a system in which the public can be notified about an ongoing crime.

It is a further object of the present invention to provide a notification system in which members of the public can be notified of an impending or ongoing criminal activity.

It is a still a further object of the present invention to provide a crime notification system in which the public can be notified by a variety of means, including satellite, cable, television, and cellular communications.

In accordance with the invention, a system for alerting the public regarding an emergency or criminal situation comprising a plurality of law enforcements nodes which issue alerts related to a criminal or emergency occurred; a central server system for receiving the alerts; a broadcast system associated with the central server for broadcasting an alert.

In a further embodiment, the invention is a system for alerting the public regarding an emergency situation comprising a plurality of law enforcements nodes which create alerts including pre-selected number codes related to a criminal or emergency matter; a central server system for receiving the alerts and converting the codes; a broadcast system associated with the central server for broadcasting an alert.

In still a further embodiment, the invention is a system for alerting the public regarding a criminal act comprising a plurality of law enforcements nodes which generate alerts related to a criminal or emergency issue and transmit the same to a central server; a central server system including an administration workstation and database for receiving the alerts and creating broadcast messages; and a broadcast system associated with the central server for broadcasting an alert via a televised broadcast, internet transmission or satellite transmission.

BRIEF DESCRIPTION OF THE FIGURES

FIG. 4*a*–4*c* illustrates a series of end user notification screens.

DESCRIPTION OF THE PRESENT EMBODIMENT

Figure 1:
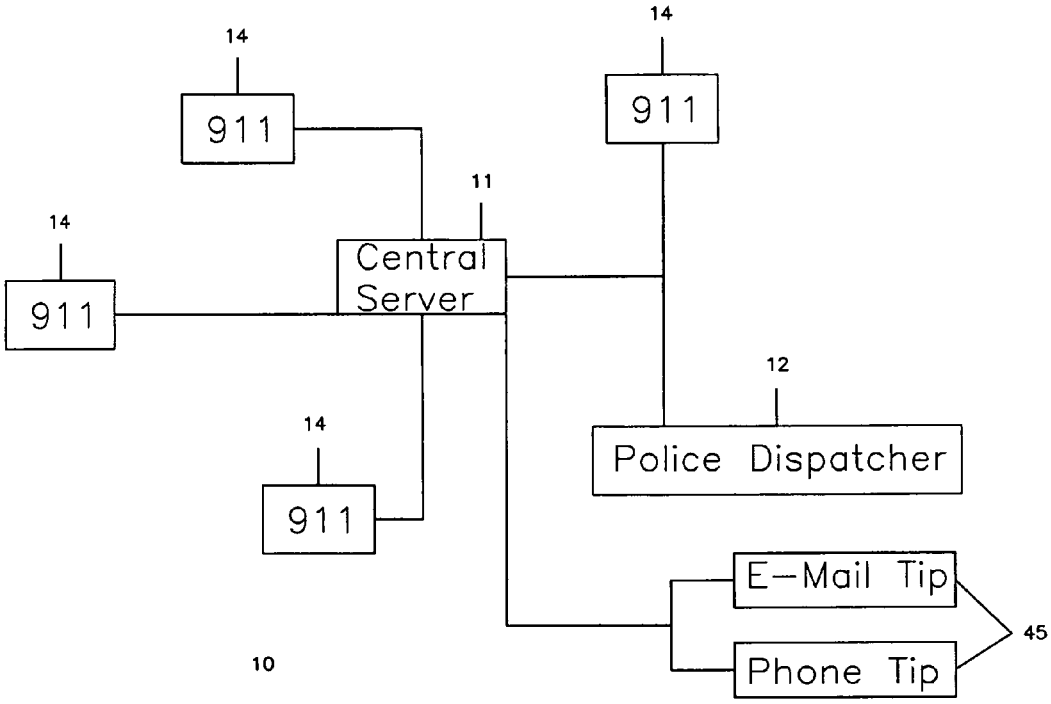
FIG. 1 is a block diagram of a global crime notification system.
Figure 2:
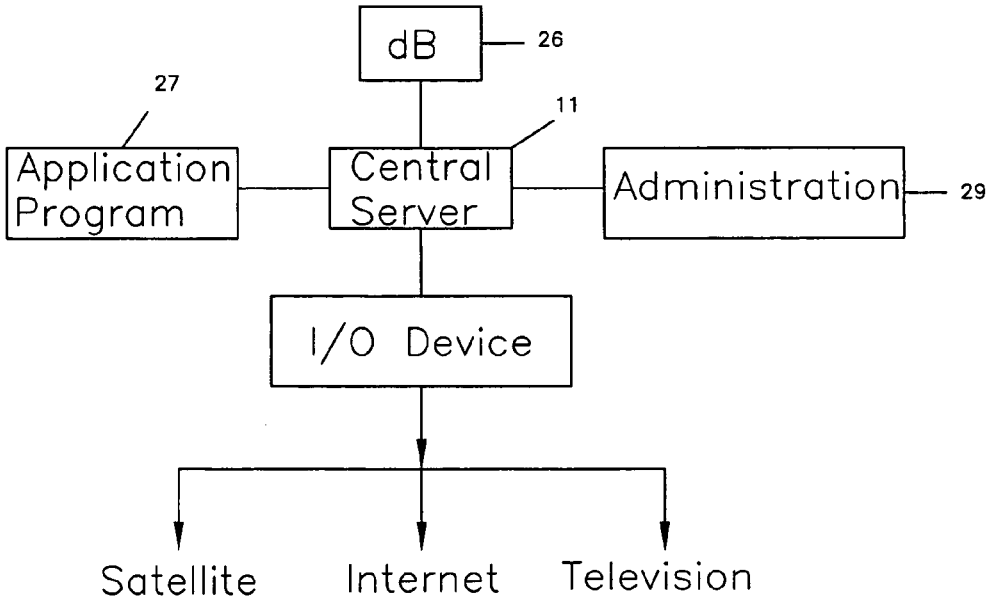
FIG. 2 is a diagram of a central server system, in accordance with the present invention.

The present invention is a now described with the reference to the enclosed Figures wherein the same numbers are utilized where applicable. Referring to FIGS. 1 and 2, the present invention in a first embodiment comprises a global network 10 which links police 12 and 911 dispatchers 14 with the public. In the first embodiment, the network 10 comprises a central computer host 11 which is linked to a network of police 12 and 911 dispatchers 14. The police and public dispatchers 14 can be linked to the network 10 through a variety of connection systems, including dedicated T-1 lines, secure internet servers or encrypted wireless connections.

Figure 5:
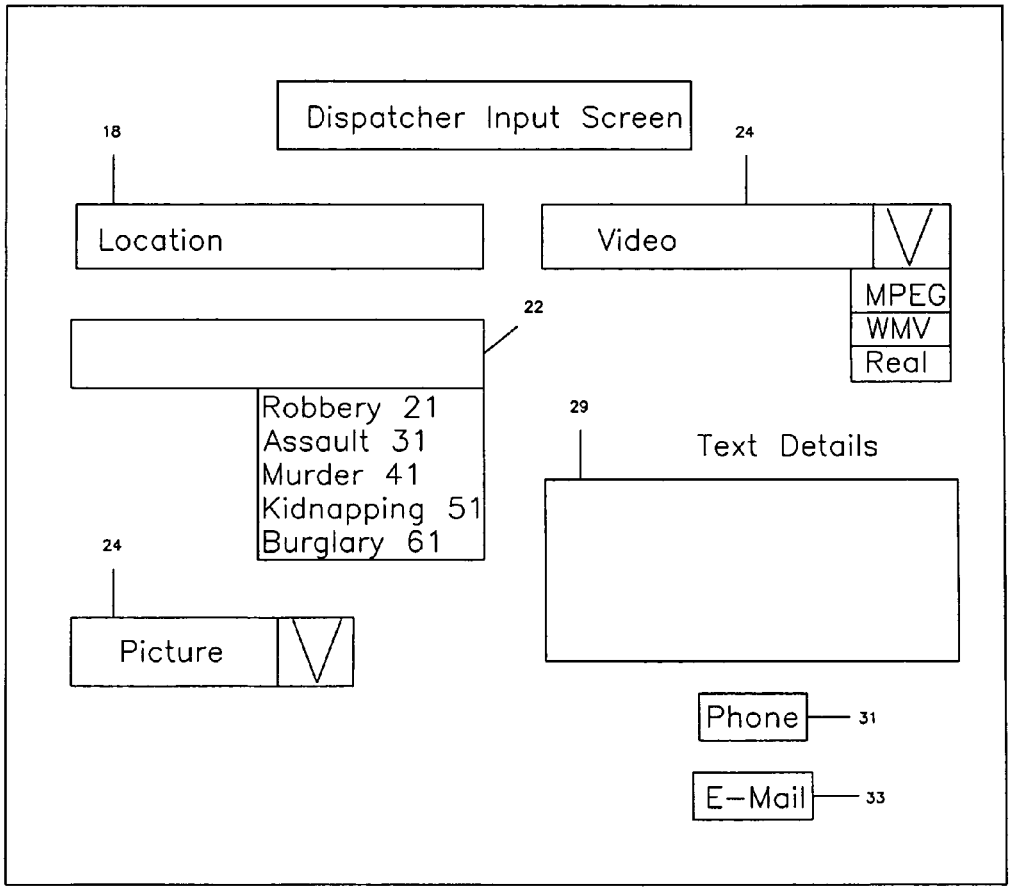
FIG. 5 illustrates an input screen which can be used by a dispatcher.

FIG. 5 illustrates a potential user screen 20 which may be used by law enforcement dispatchers. The screen includes data entry areas for the location of a crime 18, a code entry system for the type of crime 22, the ability to upload a picture or video 24 and a text box 29. A central phone number 31 or email 33 can be added.

As shown in FIG. 2, the central computer host 11 includes a database 26 and application software 27 which links those dispatchers to an output device according to a geographic region. The computer system categorizes each call by preset code 22 and triggers an alert. As noted, the central server 11 has an administration workstation 29 and database 26 and functions under a series of application programs 27 which store and retrieve data, and which create and transmit public alerts via a number of transmission means, including satellite, internet or television.

Figure 3:
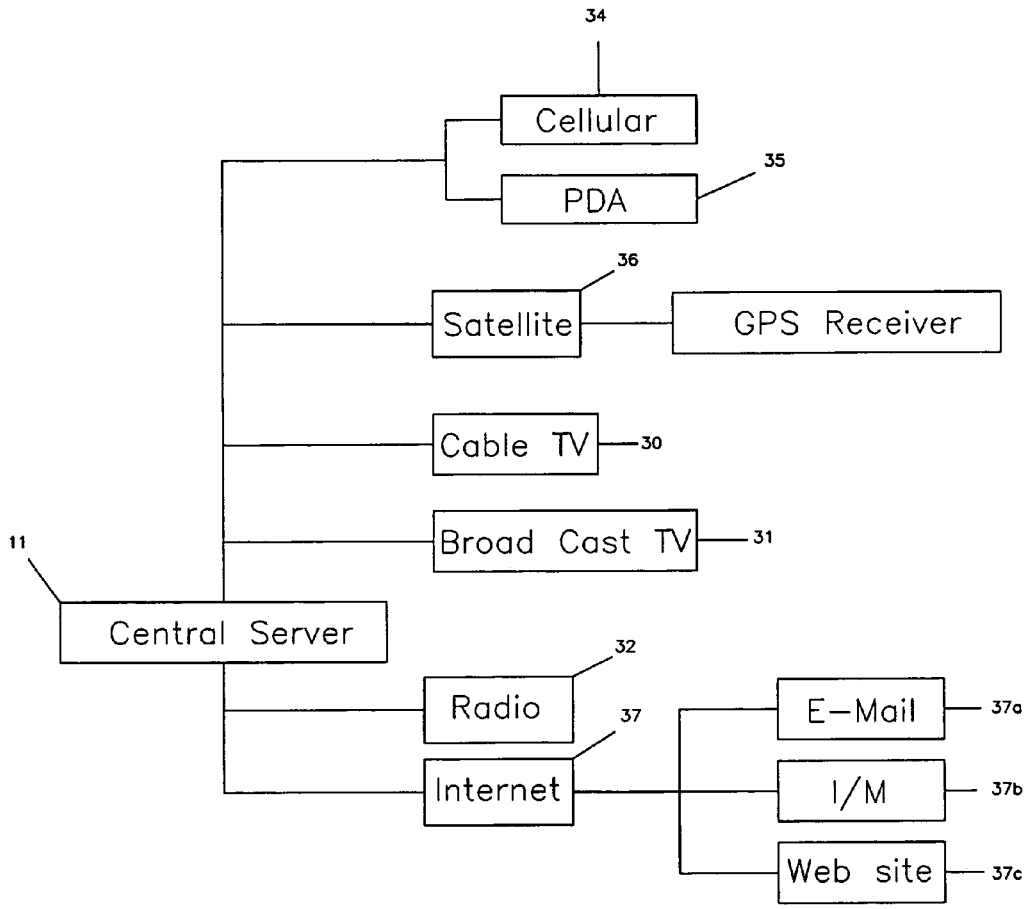
FIG. 3 is a diagram of the broadest system of the connection.

As shown in FIG. 3, the alert can be broadcast by means of a number of communication means including broadcast 30 and cable television 31, radio 32, cellular communication (phone/PDA) 34, 35, satellite 36 and via the Internet 37. The Internet communication can be by means of email, instant messaging or a stand alone website (37*a*–*c*). The system will include an ability to periodically test the system and to add upgrades as new technology becomes available which can be included in the system.

Referring to FIGS. 4*a* to 4*c*, a critical feature of a preferred embodiment invention is the inclusion of a dedicated television and/or internet portal 40 with news script accessible via the central server. Depending upon the location of the crime or incident, the news alert will be transmitted and posted on a dedicated television channel. For example, if there has been a bank robbery in a Omaha, Nebr., the Omaha dedicated affiliate will receive information and it will be posted on the local broadcast or cable network alerting members of the public.

The dedicated channel will profile criminals continually, and in a preferred embodiment, will include no commercial advertising. During a period where there are no alerts, the channel will show wanted fugitives in rotation, and may include public awareness features about crime, biological agents and sex offenders.

Figure 6:
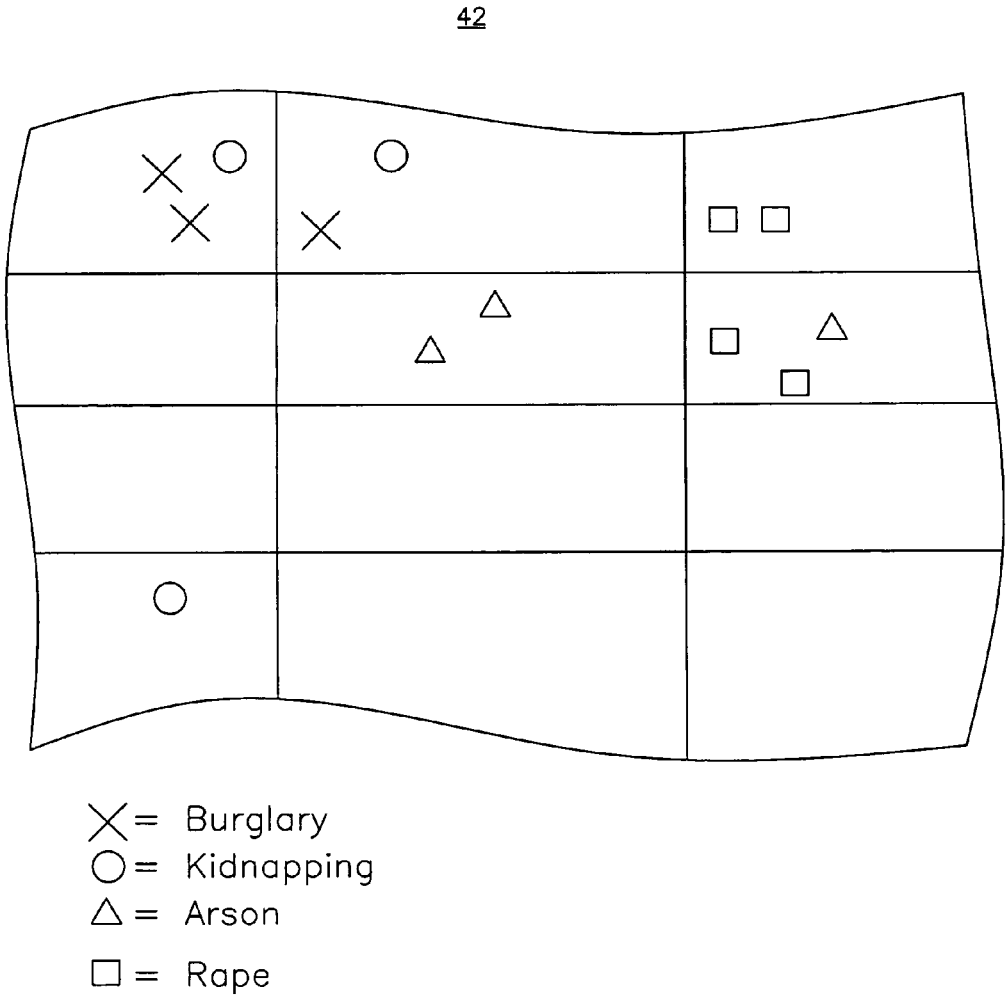
FIG. 6 illustrates a regional tracking map for use with the present invention.

As shown in FIG. 6, the invention incorporates a geographic criminal profile map 42 may be accessible by the public. The map tracks both alerts and tips by code. A map can be generated for a geographic area which shows the concentration of criminal activity and the location of criminals and wanted individuals.

As shown in FIG. 1, a further feature of the invention is ability for the public to provide tips via a telephone or email hotline 45. The invention thus processes tips and shows the probability where the criminal can be found. This feature further facilitates the offering of rewards to the public.

In a further embodiment of the invention, a global positioning system can be used to communicate with the public. Vehicles with GPS guidance systems can receive an icon of a recent crime with vehicle information. Members of the public can then contact the police or monitor the criminal activity. As additional information becomes available, the position of the icon can be adjusted and text messages made available to the public regarding suspect appearance.

The present invention has been described with reference to the above discussed preferred embodiment. The true nature and scope of the present invention is to be determined with reference to the attached claims.

The invention claimed is:

1. A system for alerting the public regarding an emergency or criminal situation comprising:

a plurality of law enforcements nodes which issue alerts related to a crime or emergency by utilizing preselected number codes associated with a criminal or emergency matter;

said law enforcement nodes being capable of sending and receiving said alerts through a central server system;

said central server system comprising an administrative workstation and database;

said central server system being capable of receiving said alerts, converting the codes, and creating broadcasts;

said central server system further being capable of directly receiving tips from the public by telephone or electronic mail, storing those tips in said database, and distributing them to police or 911 dispatchers for analysis;

a broadcast system associated with said central server system for broadcasting an alert;

said broadcast system being capable of broadcasting a localized map which displays the location and type of alert, as well as the location and type of any tips that are submitted by the public.

2. The system of claim 1 wherein the broadcast system comprises a combination of television, Internet, or wireless cellular broadcast systems.

3. The system of claim 1 wherein the broadcast system comprises a satellite transmitter.

* * * * *